US009425549B2

(12) United States Patent
Sekino

(10) Patent No.: US 9,425,549 B2
(45) Date of Patent: Aug. 23, 2016

(54) CONNECTOR

(71) Applicant: YAZAKI CORPORATION, Minato-ku, Tokyo (JP)

(72) Inventor: Tetsuya Sekino, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/959,253

(22) Filed: Dec. 4, 2015

(65) Prior Publication Data

US 2016/0164224 A1 Jun. 9, 2016

(30) Foreign Application Priority Data

Dec. 8, 2014 (JP) ..... 2014-247569

(51) Int. Cl.
*H01R 13/627* (2006.01)

(52) U.S. Cl.
CPC ..... *H01R 13/6272* (2013.01)

(58) Field of Classification Search
CPC ..... H01R 13/6272
USPC ..... 439/357, 350, 358, 353, 354, 352
See application file for complete search history.

(56) References Cited

U.S. PATENT DOCUMENTS 4,319,797 A * 3/1982 Otani ..... H01R 13/20 439/346
4,801,275 A * 1/1989 Ikeda ..... H01R 13/6272 439/350
4,915,643 A * 4/1990 Samejima ..... H01R 13/6272 439/357
5,174,786 A * 12/1992 Kato ..... H01R 13/641 439/352
5,417,586 A * 5/1995 Endo ..... H01R 13/641 439/353
5,947,763 A * 9/1999 Alaksin ..... H01R 13/4362 439/352
6,045,388 A * 4/2000 Higgins ..... H01R 13/641 439/352
6,312,277 B1 * 11/2001 Holub ..... H01R 13/6272 439/352
6,669,398 B2 * 12/2003 Wada ..... C08J 9/0004 403/322.4
6,935,887 B2 * 8/2005 Endo ..... H01R 13/641 439/352
7,140,898 B2 * 11/2006 Sanuki ..... H01R 13/502 439/314
8,070,510 B2 * 12/2011 Urano ..... H01R 13/6272 439/352
9,022,798 B2 * 5/2015 Kida ..... H01R 13/506 439/358
9,118,137 B2 * 8/2015 Suzuki ..... H01R 13/42
9,142,919 B2 * 9/2015 Osada ..... H01R 13/6272 439/352
2009/0011632 A1 * 1/2009 Ito ..... H01R 13/6272 439/357

(Continued)

FOREIGN PATENT DOCUMENTS

JP H10-199621 A 7/1998

*Primary Examiner* — Abdullah Riyami
*Assistant Examiner* — Nelson R Burgos-Guntin
(74) *Attorney, Agent, or Firm* — MOTS Law, PLLC

(57) ABSTRACT

A connector includes a housing capable of fitting with a mating housing, a locking arm swingably disposed on the housing and having a locking portion capable of locking with a locked portion of the mating housing, and locking arm protective walls disposed on the housing and arranged on both sides in a width direction of the locking arm. An engaging protrusion is disposed on each of the locking arm protective walls so as to protrude toward a side of the locking arm. An engaging recess portion is disposed on the locking arm. The engaging recess portion is positioned on a surface facing each of the locking arm protective walls, engages with the engaging protrusion, and regulates displacement toward one side of a swinging direction of the locking arm.

3 Claims, 5 Drawing Sheets

(56) References Cited

U.S. PATENT DOCUMENTS

2009/0111312 A1* 4/2009 Nakata ..... H01R 13/6277 439/357
2009/0149054 A1* 6/2009 Zheng ..... H01R 13/641 439/357
2014/0106602 A1* 4/2014 Hiramatsu ..... H01R 13/6272 439/357
2014/0179146 A1* 6/2014 Hamai ..... H01R 13/639 439/357
2015/0255928 A1* 9/2015 Liptak ..... H01R 13/6581 439/357
2016/0156130 A1* 6/2016 Sekino ..... H01R 13/62933 439/345
2016/0164224 A1* 6/2016 Sekino ..... H01R 13/6272 439/352

* cited by examiner

CONNECTOR

CROSS REFERENCE TO RELATED APPLICATIONS

This application claims the priority of Japanese Patent Application No. 2014-247569, filed on Dec. 8, 2014, the entire content of which are incorporated herein by reference.

BACKGROUND

1. Technical Field

The present invention relates to a connector.

2. Related Art

In the related art, a connector including a housing, a locking arm, and locking arm protective walls, has been known. The housing is capable of fitting with a mating housing. The locking arm is swingably disposed on the housing and has a locking portion capable of locking with a locked portion of the mating housing. The locking arm protective walls are disposed on the housing and are arranged at least on both sides in a width direction of the locking arm (refer to JPH 10-199621 A).

In the connector, the locked portion is disposed so as to protrude on each of the sides in the width direction of the locking arm. A warp-preventing piece that locks with the locked portion, is arranged on an upper surface of each of the locking arm protective walls. Engaging the locked portion with the warp-preventing piece regulates displacement in a warp direction that is one side of a swinging direction of the locking arm when the locking arm is restored.

SUMMARY

However, in the connector described in the above JPH 10-199621 A, the locked portion is disposed so as to protrude from each of the sides in the width direction of the locking arm. Thus, there is a need for securing an arrangement space for arranging the locked portion between the locking arm protective walls arranged on both the sides in the width direction of the locking arm. Therefore, the locking arm protective walls are arranged so as to extend in the width direction and the connector tends to increase in size.

In contrast, the other embodiment in JPH 10-199621 A discloses a connector including a locking hole and a warp-preventing portion. A locked portion that is disposed so as to protrude on a locking arm, is inserted into the locking hole disposed on each of locking arm protective walls. An upper edge of the locking hole has an opening so that the warp-preventing portion that locks the locked portion is disposed.

In the above-mentioned connector, the locked portion that is disposed so as to protrude on the locking arm, is inserted into the locking hole that passes through each of the locking arm protective walls. Accordingly, there is no need for securing the arrangement space for arranging the locked portion between the locking arm protective walls. The connector can be downsized.

However, in the connector according to the other embodiment in JPH 10-199621 A, the upper edge of the locking hole has the opening for locking the locked portion. Thus, since strength of the warp-preventing portion lowers, when the locked portion and the warp-preventing portion engage with each other, there is a risk that the warp-preventing portion is damaged.

An object of the present invention is to provide a connector capable of being downsized and preventing damage caused by displacement toward one side of a swinging direction of a locking arm.

A connector according to one aspect of the present invention includes a housing capable of fitting with a mating housing, a locking arm swingably disposed on the housing and having a locking portion capable of locking with a locked portion of the mating housing, and locking arm protective walls disposed on the housing and arranged at least on both sides in a width direction of the locking arm. An engaging protrusion is disposed on each of the locking arm protective walls so as to protrude toward the locking arm. An engaging recess portion is disposed on the locking arm, the engaging recess portion being positioned on a surface facing each of the locking arm protective walls, engaging with the engaging protrusion, and regulating displacement toward one side of a swinging direction of the locking arm.

In the connector, the locking arm includes the engaging recess portion. The engaging recess portion is positioned on a surface facing each, of locking arm protective walls, engages with the engaging protrusion disposed so as to protrude on each of the plurality of the locking arm protective walls, and regulates the displacement toward the one side of the swinging direction of the locking arm. Therefore, the engaging recess portion houses the engaging protrusion. There is no need for securing an arrangement space for arranging the engaging protrusion between the locking arm protective walls. The connector can be downsized.

The engaging protrusion and the engaging recess portion engage with each other so as to regulate the displacement toward the one side of the swinging direction of the locking arm. Therefore, without engaging the engaging protrusion with a portion that has lowered its strength like an edge portion having an opening, strength of the engaging recess portion can be retained and damage of the engaging recess portion can be prevented.

Therefore, the locking arm and the locking arm protective walls are arranged adjacent to each other so that the above connector can be downsized. The strength of the engaging recess portion can be retained and the damage caused by the displacement toward the one side of the swinging direction of the locking arm can be prevented.

The locking portion may be disposed on a side of a first end in a longitudinal direction of the locking arm. A releasing-operation portion that releases locking of the locking portion with the locked portion due to a swinging operation by pressing force, may be disposed on a side of a second end in the longitudinal direction of the locking arm. The engaging recess portion may be disposed on a side of the releasing-operation portion of the locking arm.

In the connector, since the engaging recess portion is disposed on the side of the releasing-operation portion of the locking arm, engagement between the engaging protrusion and the engaging recess portion gives no effect to locking between the locking portion and the locked portion. Therefore, a fitting state between the housing and the mating housing can be stably retained.

An end surface in the longitudinal direction of the locking arm may be positioned inside an end surface in a longitudinal direction of each of the locking arm protective walls.

In the connector, since the end surface in the longitudinal direction of the locking arm is positioned inside the end surface in the longitudinal direction of each of the locking arm protective walls, the locking arm protective walls can securely protect the locking arm and interference between the locking arm and a peripheral member can be prevented.

According to one aspect of the present invention, there can be provided the connector capable of being downsized and preventing the damage caused by the displacement toward the one side of the swinging direction of the locking arm.

DETAILED DESCRIPTION

Figure 1:
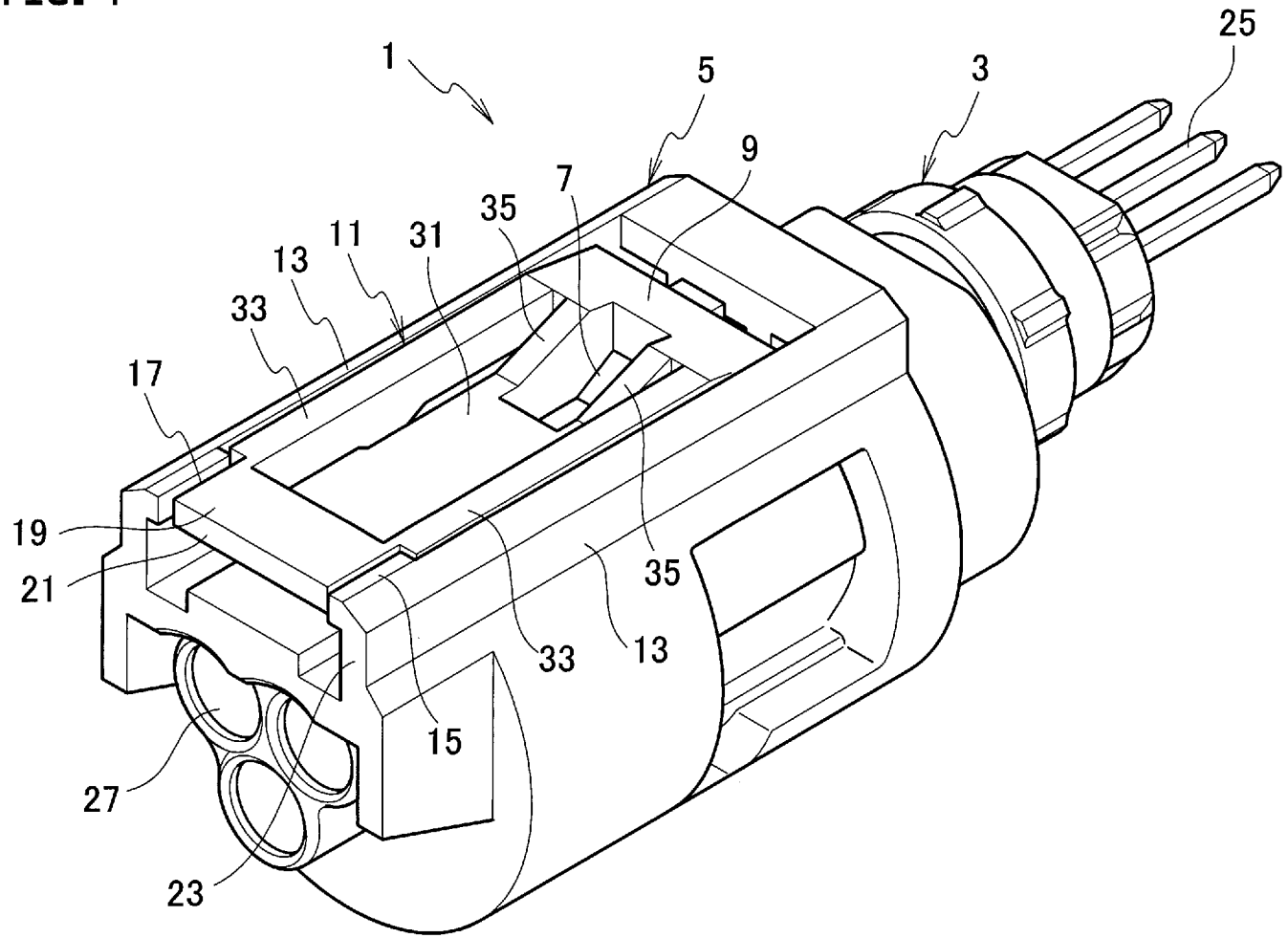
FIG. 1 is a perspective view of a connector according to an embodiment of the present invention.
Figure 2:
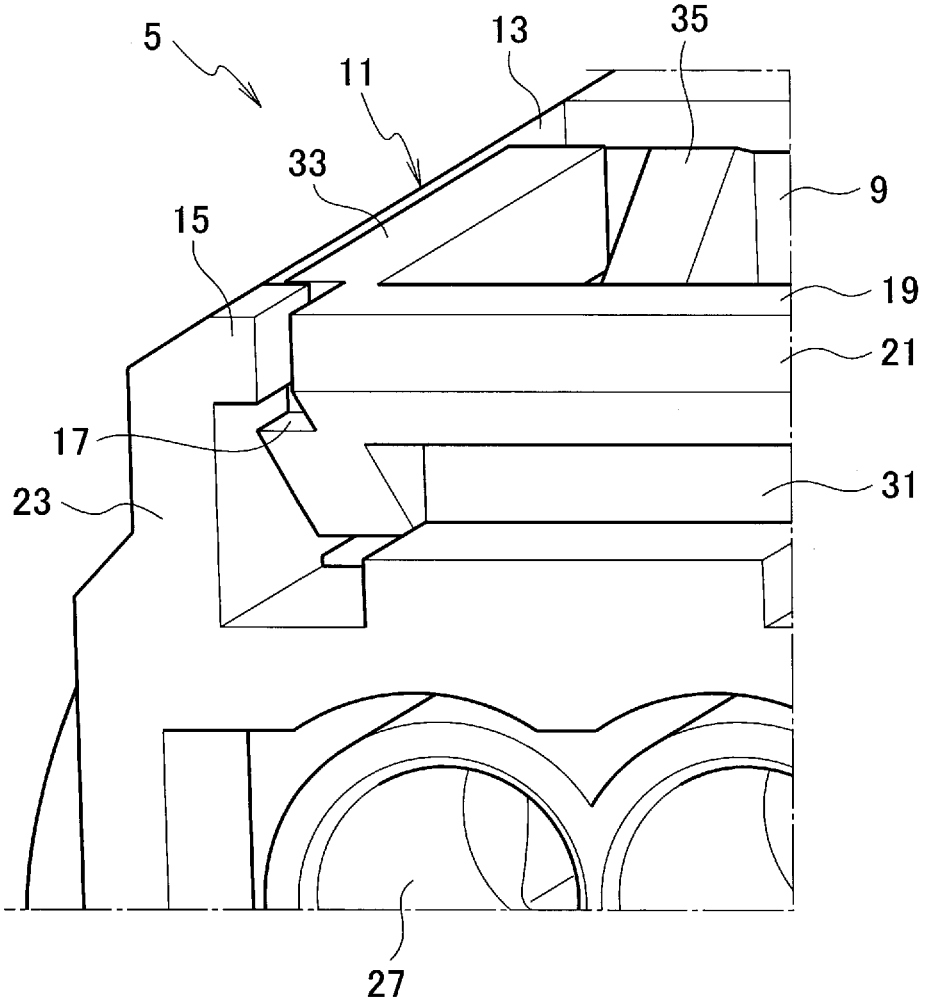
FIG. 2 is an enlarged perspective view of a main portion of a housing of the connector according to the embodiment of the present invention.
Figure 3:
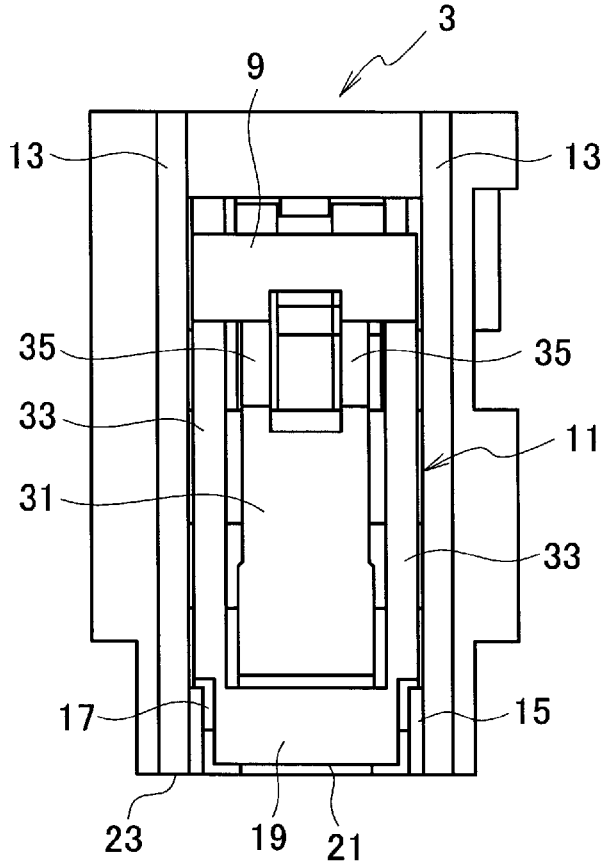
FIG. 3 is a top view of the housing of the connector according to the embodiment of the present invention.
Figure 4:
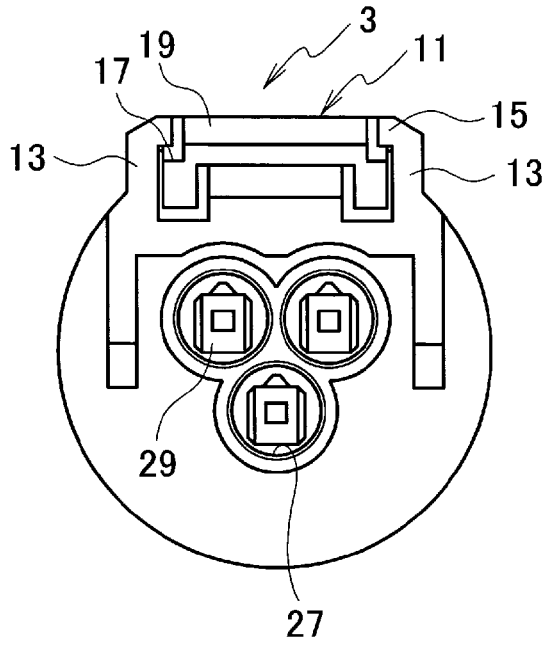
FIG. 4 is a front view of the housing of the connector according to the embodiment of the present invention.
Figure 5:
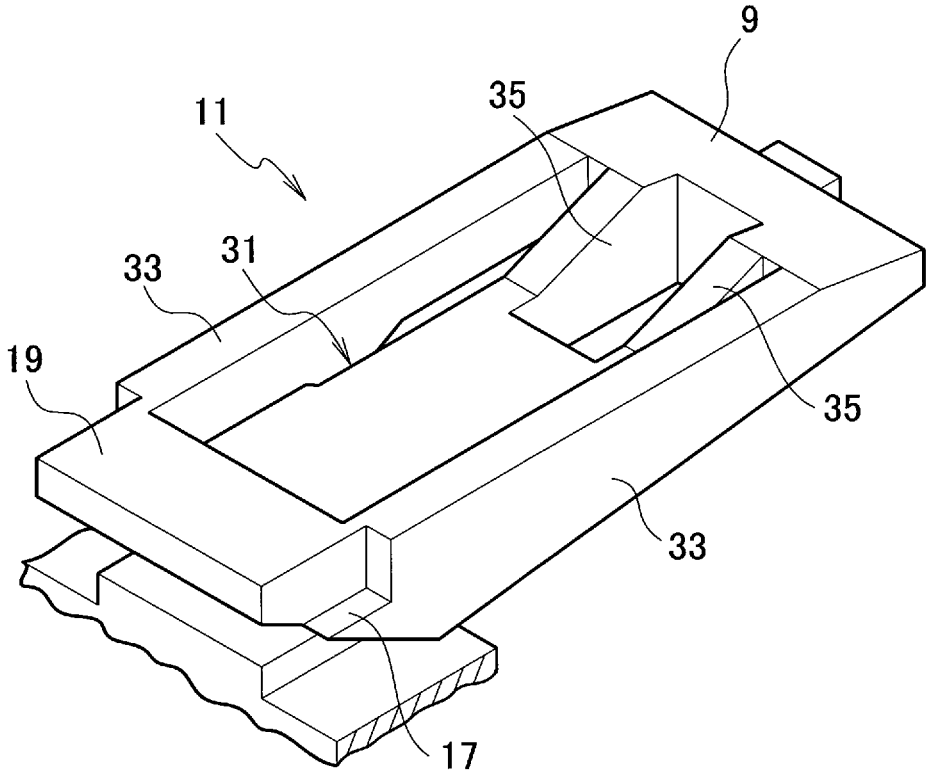
FIG. 5 is a perspective view of a locking arm of the connector according to the embodiment of the present invention.
Figure 6A:
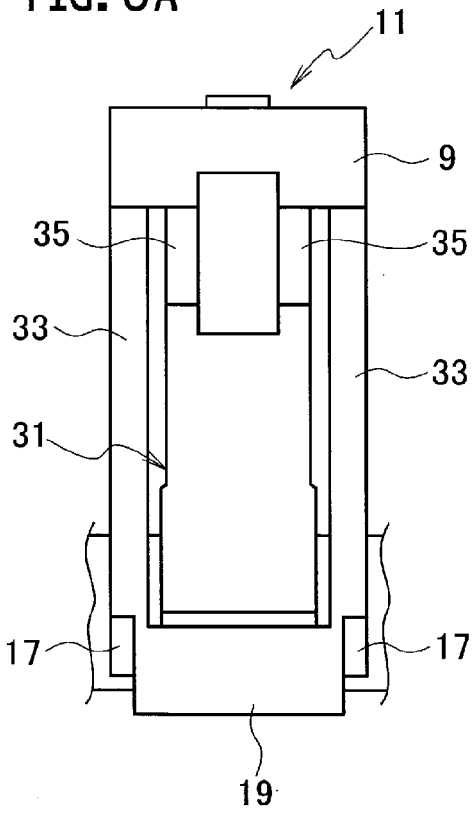
FIG. 6A is a top view of the locking arm of the connector according to the embodiment of the present invention.
Figure 6B:
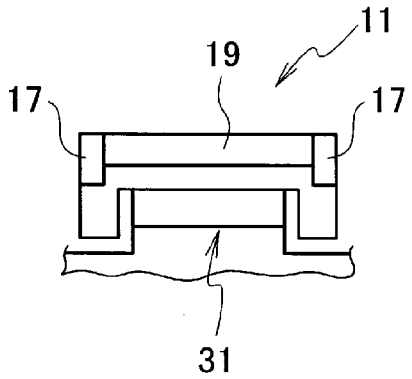
FIG. 6B is a front view of the locking arm of the connector according to the embodiment of the present invention.
Figure 6C:
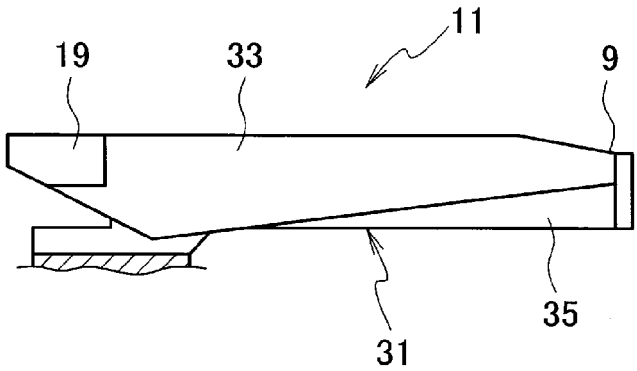
FIG. 6C is a side view of the locking arm of the connector according to the embodiment of the present invention.

A connector according to an embodiment of the present invention will be described below with reference to FIGS. 1 to 6C.

A connector 1 according to the present embodiment includes a housing 5, a locking arm 11, and locking arm protective walls 13, 13. The housing 5 is capable of fitting with a mating housing 3. The locking arm 11 is swingably disposed on the housing 5, and has a locking portion 9 capable of locking with a locked portion 7 of the mating housing 3. The locking arm protective walls 13, 13 are disposed in the housing 5 and are arranged on both sides in a width direction of the locking arm 11.

Each of the locking arm protective walls 13 includes an engaging protrusion 15 disposed so as to protrude toward the locking arm 11. The locking atm 11 includes an engaging recess portion 17. The engaging recess portion 17 is positioned on a surface facing each of the locking arm protective walls 13, engages with the engaging protrusion 15, and regulates displacement toward one side of a swinging direction of the locking arm 11.

The locking portion 9 is disposed on a side of one end in a longitudinal direction of the locking arm 11. A releasing-operation portion 19 is disposed on a side of the other end in the longitudinal direction of the locking arm 11. The releasing-operation portion 19 releases locking of the locking portion 9 with the locked portion 7 due to a swinging operation by pressing force. The engaging recess portion 17 is disposed on a side of the releasing-operation portion 19 of the locking arm 11.

An end surface 21 in the longitudinal direction of the locking arm 11 is positioned inside an end surface 23 in a longitudinal direction of each of the locking arm protective walls 13.

As illustrated in FIGS. 1 to 6, the mating housing 3 includes an insulating material, such as a synthetic resin, and is formed so as to be cylindrical. The mating housing 3 houses mating terminals 25. Each of the mating terminals 25 is electrically coupled to, for example, a power source or an apparatus, and is a male terminal having a tab-shaped connection portion. The locked portion 7 is disposed so as to protrude on an upper surface of the mating housing 3 that houses the mating terminals 25.

A front side of the locked portion 7 in a fitting direction with the housing 5 has an inclined plane. A rear side of the locked portion 7 in the fitting direction with the housing 5 has a locking surface that is formed so as to be substantially perpendicular to an upper surface. The mating housing 3 including the locked portion 7 disposed on the mating housing 3, can fit with the housing 5.

Note that a seal member, such as a packing material, is arranged between the mating housing 3 and the housing 5. The seal member is in contact with an external circumferential surface of the mating housing 3 and an internal circumferential surface of the housing 5, and divides an inside and an outside of the housing 5 for waterproofing.

The housing 5 includes an insulating material, such as a synthetic resin, and are formed so as to have a housing that includes an opening into which the mating housing 3 can be inserted, on a side of one end. The housing 5 includes a plurality of terminal housing chambers 27 disposed inside and the locking arm 11 swingably disposed on a side of an upper surface of the housing 5.

The plurality of terminal housing chambers 27 (three in this case) is formed and arranged at a central portion of the housing 5 in a longitudinal direction of the housing 5. Each of the terminal housing chambers 27 houses each of a plurality of terminals 29 that include a female terminal having a box-shaped connection portion capable of coupling to the connector portion of each of the mating terminals 25 through an opening disposed on a side of the other end of the housing 5.

The plurality of terminals 29 includes a conductive material. A crimp portion of each of the plurality of terminals 29 is crimped with and electrically coupled to a terminal portion of an electric wire (not illustrated) that is coupled to, for example, a power source or an apparatus. Each of the plurality of terminals 29 is inserted into each of the plurality of terminal housing chambers 27 through the opening disposed on the side of the other end of the housing 5. A locking lance (not illustrated) disposed so as to be flexible inside each of the plurality of terminal housing chambers 27 and a spacer (not illustrated) to be inserted into each of the plurality of terminal housing chambers 27 lock the terminal 29 so that the terminal 29 is prevented from coming off each of the plurality of terminal housing chambers 27.

A seal member such as a rubber stopper for waterproofing an inside of each of the plurality of terminal housing chambers 27, is attached to an external circumference of the electric wire of the terminal portion coupled to each of the plurality of terminals 29 in close contact with an internal wall surface of each of the plurality of terminal housing chambers 27.

The mating housing 3 and the housing 5 fit with each other so that the connection portion of each of the mating terminals 25 to be inserted through an opening on a side of one end of each of the plurality of terminal housing chambers 27 is inserted into a box-shaped connector portion. Then, the above plurality of terminals 29 is electrically coupled to the plurality of mating terminals 25.

Locking between the locking portion 9 of the locking arm 11 and the locked portion 7 of the mating housing 3 that retain a fitting state between the mating housing 3 and the housing 5, retains a connecting state between each of the plurality of terminals 29 and each of the mating terminals 25.

The locking arm 11 is arranged above the housing 5 by a supporting portion 31 so as to be swingable in a height direction of the housing 5. The locking arm 11 is formed of a pair of joined portions 33, 33, the locking portion 9, and a releasing-operation portion 19 so as to be frame-shaped. The pair of joined portions 33, 33 is positioned outside the supporting portion 31 and is disposed in the longitudinal direction of the housing 5. The locking portion 9 is disposed on the side of one end of the locking arm 11. The releasing-operation portion 19 is disposed on the side of the other end of the locking arm 11.

The locking portion 9 is a coupling portion that couples a side of one end of the pair of joined portions 33, 33 and a pair of branch portions 35, 35. The pair of joined portions 33, 33 is disposed in the longitudinal direction of the housing 5. The pair of branch portions 35, 35 is arranged between the pair of joined portions 33, 33 and branches at the supporting portion 31 disposed in the longitudinal direction of the housing 5.

A front side of the locking portion 9 in a fitting direction with the mating housing 3 positioned below the locking portion 9, has an inclined plane. A rear side of the locking portion 9 in the fitting direction with the mating housing 3 in a recess portion formed of the pair of branch portions 35, 35, has a locking surface that is formed so as to be substantially perpendicular to an upper surface of the locking portion 9.

Upon fitting between the mating housing 3 and the housing 5, the inclined plane of the above locking portion 9 abuts on the inclined plane of the locked portion 7 so that the locking portion 9 swings the locking arm 11 upward. When the mating housing 3 and the housing 5 fit with each other, the locking arm 11 gets over the locked portion 7 and swings so as to be restored downward. The locked portion 7 is housed in the recess portion formed of the pair of branch portions 35, 35 and the locking portion 9. The locking surface of the locking portion 9 locks the locking surface of the locked portion 7 so as to retain the fitting state between the mating housing 3 and the housing 5.

The releasing-operation portion 19 is arranged outside the supporting portion 31 and on a side of the other end of the pair of joined portions 33, 33. The releasing-operation portion 19 is a coupling portion that couples the side of the other end of the pair of joined portions 33, 33. The locking arm 11 is formed of the releasing-operation portion 19, the pair of joined portions 33, 33, and the locking portion 9 on the side of one end of the pair of joined portions 33, 33 so as to be frame-shaped.

By pressing an upper surface of the releasing-operation portion 19 downward by, for example, a finger of an operator, the above releasing-operation portion 19 swings a side of the locking portion 9 of the locking arm 11 upward and releases locking between the locking portion 9 and the locked portion 7. Accordingly, fitting between the mating housing 3 and the housing 5 can be released.

Upon locking of the locking portion 9 and the locked portion 7, when the side of the locking portion 9 is displaced upward, a side of the releasing-operation portion 19 of the above locking arm 11 is displaced downward. When the locking portion 9 and the locked portion 7 lock each other, the side of the locking portion 9 is displaced downward and the side of the releasing-operation portion 19 is displaced upward by restoration of the locking arm 11.

The locking arm protective walls 13, 13 are arranged on both sides in the width direction of the locking arm 11 including the releasing-operation portion 19 and the locking portion 9 disposed thereon. Each of the locking arm protective walls 13, 13 is formed of one member continuing with the housing 5.

The locking arm protective walls 13 are positioned on both the sides in the width direction of locking arm 11. An upper surface of each of the locking arm protective walls 13 is arranged so as to be positioned above the upper surface of the locking arm 11 in a free state of the locking arm 11.

Arranging the locking arm protective walls 13 around the locking arm 11 can protect the locking arm 11 so as to prevent interference between the locking arm 11 and a peripheral member.

Only protecting the locking arm 11 with the locking arm protective walls 13 causes external force to act on the side of the releasing-operation portion 19. When the locking arm 11 is excessively displaced to the one side of the swinging direction (upward direction from the upper surfaces of the locking arm protective walls 13), the locking arm 11 may be damaged.

The engaging protrusions 15 and the engaging recess portions 17 that regulate the displacement to the one side of the swinging direction of the locking arm 11, are disposed on the side of the releasing-operation portion 19 of the locking arm 11.

The engaging protrusions 15 are disposed so as to protrude from internal surfaces of the locking arm protective walls 13, 13 toward both side-surfaces in the width direction of the locking arm 11. The engaging protrusions 15 are housed in the engaging recess portions 17 of the locking arm 11 in the free state of the locking arm 11.

The engaging recess portions 17 are individually disposed on surfaces, facing the engaging protrusions 15, 15, positioned on both sides in the width direction of the side of the releasing-operation portion 19 of the locking arm 11. Each of the engaging recess portions 17 houses each of the engaging protrusions 15. When the side of the releasing-operation portion 19 of the locking arm 11 is excessively displaced upward, a facing surface of each of the engaging protrusions 15 and a facing surface of each of the engaging recess portions 17 engages with each other.

The engagement between each of the engaging protrusions 15 and each of the engaging recess portions 17 regulates the upward displacement on the side of the releasing-operation portion 19 of the locking arm 11. Therefore, the side of the releasing-operation portion 19 of the locking arm 11 does not project from the upper surfaces of the locking arm protective walls 13.

In addition, each of the engaging protrusions 15 disposed so as to protrude on each of the locking arm protective walls 13, is housed in each of the engaging recess portions 17 disposed on both the sides in the width direction of the locking arm 11. Thus, there is no need for an arrangement space for arranging the engaging protrusions 15 between each of the locking arm protective walls 13 and each of the side surfaces of the locking arm 11. Accordingly, the locking arm 11 and the locking arm protective walls 13, 13 can be arranged so as to be adjacent to each other. The connector 1 can be downsized in the width direction.

Furthermore, the engagement between each of the engaging protrusions 15 and each of the engaging recess portions 17 is engagement between a lower surface of each of the engaging protrusions 15 and an upper surface of a bottom wall of each of the engaging recess portions 17 that are surfaces facing each other, and is not engagement in which an opening is arranged at a part of an engaging portion and strength lowers. Accordingly, sufficient engaging strength can be retained and the damage of the engaging recess portions 17 can be prevented.

The end surface 21 in the longitudinal direction of the locking arm 11, namely here the end surface 21 on the side of the releasing-operation portion 19 in the longitudinal direction of the locking arm 11, is positioned inside an end surface 23 in the longitudinal direction of each of the locking arm protective walls 13.

Accordingly, the locking arm 11 does not project from each of the locking arm protective walls 13 in the longitudinal direction. The locking arm protective walls 13 can protect a periphery of the locking arm 11. Interference between the locking arm 11 and a peripheral member can be prevented, and swinging of the locking arm 11 can be stabilized.

In particular, the engaging recess portions 17 that engage with the engaging protrusions 15, are positioned on the side of the releasing-operation portion 19 of the locking arm 11. Therefore, the locking arm protective walls 13 can securely protect the engaging recess portions 17, and the damage of the engaging recess portions 17 caused by the interference with the peripheral member can be prevented.

In the connector 1, each of the engaging recess portions 17 is positioned on the facing surface with respect to each of the locking arm protective walls 13, engages with each of the engaging protrusions 15 that are disposed so as to protrude on each of the locking arm protective walls 13, and regulates the displacement toward the one side of the swinging direction of the locking arm 11. Thus, each of the engaging protrusions 15 is housed in each of the engaging recess portions 17. Accordingly, there is no need for securing the arrangement space for arranging the engaging protrusions 15 between the locking arm protective walls 13, 13. The connector can be downsized.

Each of the engaging protrusions 15 and each of the engaging recess portions 17 engage with each other so as to regulate the displacement toward the one side of the swinging direction of the locking arm 11. Thus, each of the engaging protrusions 15 does not engage with an edge portion that has an opening and lowered strength. Accordingly, the strength of the engaging recess portions 17 can be retained and the damage of the engaging recess portions 17 can be prevented.

Therefore, the locking arm 11 and the locking arm protective walls 13 can be adjacent to each other so that the above connector 1 can be downsized. The strength of the engaging recess portions 17 can be retained, and the damage caused by the displacement toward the one side of the swinging direction of the locking arm 11 can be prevented.

The engaging recess portions 17 are disposed on the side of the releasing-operation portion 19 of the locking arm 11. Accordingly, the engagement between each of the engaging protrusions 15 and each of the engaging recess portions 17 gives no effect to the locking between the locking portion 9 and the locked portion 7. The fitting state between the housing 5 and the mating housing 3 can be stably retained.

Furthermore, the end surface 21 in the longitudinal direction of the locking arm 11 is positioned inside the end surface 23 in the longitudinal direction of each of the locking arm protective walls 13. Accordingly, the locking arm protective walls 13 can securely protect the locking arm 11. The interference between the locking arm 11 and the peripheral member can be prevented.

Note that, in the connector according to the embodiment of the present invention, the swinging direction of the locking arm is defined as the height direction of the housing. The embodiment of the present invention is not limited to this. The swinging direction of the locking arm may be arranged in the width direction of the housing.

The engaging protrusions and the engaging recess portions are disposed on the side of the releasing-operation portion of the locking arm. The embodiment of the present invention is not limited to this. The engaging protrusions and the engaging recess portions may be disposed on the side of the locking portion of the locking arm. In this case, since the locking arm swings, the engaging direction between each of the engaging protrusions and each of the engaging recess portions may be arranged so as to be reverse to that between each of the engaging protrusions and each of the engaging recess portions disposed on the side of the releasing-operation portion.

As an end surface in the longitudinal direction of the locking arm, the end surface on the side of the releasing-operation portion is illustrated. An end surface on the side of the locking portion is positioned inside an end surface in the longitudinal direction of each of the locking arm protective walls. The locking arm is entirely protected by the locking arm protective walls.

The locking arm protective walls are arranged on both the sides in the width direction of the locking arm, but are not limited to this. The locking arm protective walls may be further disposed on both the sides in the longitudinal direction of the locking arm so as to cover the periphery of the locking arm.

What is claimed is:

1. A connector comprising:

a housing capable of fitting with a mating housing;

a locking arm swingably disposed on the housing and having a locking portion capable of locking with a locked portion of the mating housing; and locking arm protective walls disposed on the housing and arranged at least on both sides in a width direction of the locking arm, wherein an engaging protrusion is disposed on each of the locking arm protective walls so as to protrude toward the locking arm, an engaging recess portion is disposed on the locking arm, the engaging recess portion being positioned on a surface facing each of the locking arm protective walls, engaging with the engaging protrusion, and regulating displacement toward one side of a swinging direction of the locking arm.

2. The connector according to claim 1, wherein the locking portion is disposed on a side of a first end in a longitudinal direction of the locking arm, a releasing-operation portion that releases locking of the locking portion with the locked portion due to a swinging operation by pressing force, is disposed on a side of a second end in the longitudinal direction of the locking arm, and the engaging recess portion is disposed on a side of the releasing-operation portion of the locking arm.

3. The connector according to claim 1, wherein an end surface in the longitudinal direction of the locking arm is positioned inside an end surface in a longitudinal direction of each of the locking arm protective walls.

* * * * *